US010108127B2

(12) United States Patent
Yamaguchi

(10) Patent No.: US 10,108,127 B2
(45) Date of Patent: Oct. 23, 2018

(54) DUPLEX PRINTING IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Masao Yamaguchi, Katsushika Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/672,575

(22) Filed: Aug. 9, 2017

(65) Prior Publication Data

US 2018/0081315 A1 Mar. 22, 2018

(30) Foreign Application Priority Data

Sep. 21, 2016 (JP) ..... 2016-184212

(51) Int. Cl.
*G03G 21/16* (2006.01)
*G03G 15/00* (2006.01)

(52) U.S. Cl.
CPC ..... *G03G 15/6514* (2013.01); *G03G 21/1633* (2013.01); *G03G 21/1647* (2013.01); *B65H 2402/45* (2013.01); *G03G 2221/169* (2013.01); *G03G 2221/1651* (2013.01); *G03G 2221/1687* (2013.01)

(58) Field of Classification Search
CPC ..... G03G 15/6514; G03G 21/1633; G03G 21/1647; G03G 2221/1651; G03G 2221/1672; G03G 2221/1687; G03G 2221/169; B65H 2402/45
See application file for complete search history.

(56) References Cited

U.S. PATENT DOCUMENTS

2005/0067773 A1 3/2005 Yoshida et al.
2011/0148034 A1 6/2011 Inoue
2013/0251397 A1 9/2013 Ao et al.
(Continued)

FOREIGN PATENT DOCUMENTS

JP 2014-030024 A 2/2014
JP 2014-085448 5/2014
JP 2016-142804 A 8/2016

OTHER PUBLICATIONS

Extended European Search Report dated Feb. 5, 2018 filed in counterpart European Patent Application No. 17189345.6 (10 pages).

*Primary Examiner* — Sophia S Chen
(74) *Attorney, Agent, or Firm* — Patterson & Sheridan, LLP

(57) ABSTRACT

An image forming apparatus includes an openable/closable cover body in a main body. The cover body has a first cover member, a second cover member, an engagement member, an elastic body, and a support member. The support member rotatably supports the engagement member. The support member collides with the engagement member which is energized by the elastic body and is rotated when the cover body becomes in a closed state, to stop rotation of the engagement member. The support member is fitted on the first cover member separately from the second cover member.

9 Claims, 8 Drawing Sheets

(56) References Cited

U.S. PATENT DOCUMENTS

| | | | | |
|---|---|---|---|---|
| 2015/0084277 | A1* | 3/2015 | Maruyama | G03G 21/1633 271/272 |
| 2015/0346677 | A1* | 12/2015 | Aoi | G03G 21/1633 399/107 |
| 2016/0318724 | A1 | 11/2016 | Yamaguchi | |
| 2017/0248901 | A1* | 8/2017 | Ueshima | G03G 21/1633 |

* cited by examiner

DUPLEX PRINTING IMAGE FORMING APPARATUS

CROSS-REFERENCE TO RELATED APPLICATION

This application is based upon and claims the benefit of priority from the prior Japanese Patent Application No. 2016-184212, filed on Sep. 21, 2016, the entire contents of which are incorporated herein by reference.

FIELD

Embodiments described herein relate generally to a sheet forming apparatus having an openable/closable cover and capable of performing duplex printing.

BACKGROUND

There exists an image forming apparatus capable of performing duplex printing. When this image forming apparatus performs duplex printing, it firstly forms an image on the front surface of a sheet, next reverses the front/back of the sheet, and then forms an image on the back surface of the sheet.

The image forming apparatus has an openable/closable side cover for eliminating a jam, when sheet clogging (jam) has occurred in the apparatus. When the jam has occurred, a user opens this side cover, removes the jammed sheet from the apparatus, and then closes the side cover.

When the user closes the side cover, an impact sound of some sort is generated. In addition, as the material for the side cover, a hard material such as a hard polycarbonate material is used for keeping the strength of the side cover. But when a hard material is used as the material of the side cover, the stiffness of the side cover is increased, and when the above-described impact sound is generated, the resonance frequency thereof becomes high. By this means, the sound quality of the impact sound when the user has closed the side cover becomes high-pitch, and thereby the user feels uncomfortable.

In addition, in order to keep the strength of the side cover, a large number of large and small ribs are arranged on the inner side surface (a surface at the inner side of the image forming apparatus) of the side cover, and thereby the side cover is reinforced. However, when the ribs are arranged, since an area of each of the ribs is small, a wavelength of the vibration to be propagated in the relevant rib becomes short, and thereby the above-described resonance frequency becomes high. By this means, the sound quality of an impact sound generated when the user has closed the side cover becomes high, and accordingly the user feels uncomfortable.

There is a case in which ventilation openings are disposed on the upper surface of the side cover, in order to release heat from the upper portion of the side cover when the side cover is in the closed state. When the openings like these are disposed, since the strength of the side cover becomes weak, countermeasure for keeping the strength such as providing the above-described rib is required, but the countermeasure for keeping the strength becomes a factor for making the sound quality of the impact sound high-pitched.

The high-itched sound quality like this makes the user feel uncomfortable, and in addition, there may be a case in which a user is made to feel that the quality of the material of the image forming apparatus is not so good and the structure thereof is rough and lacking in elegance.

DETAILED DESCRIPTION

Figure 1A:
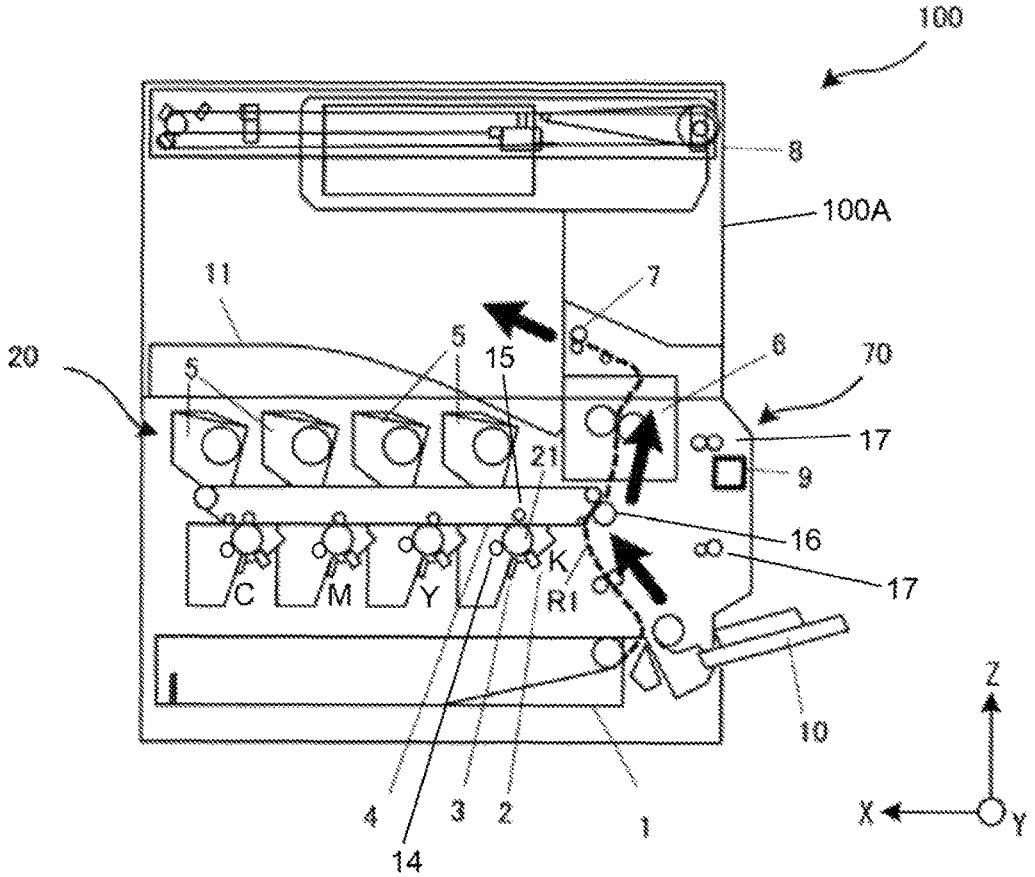
FIG. 1A to FIG. 1C are diagrams for describing a configuration of an image forming apparatus and a sheet conveying direction at the time of printing.

According to an embodiment, an image forming apparatus has a main body and a cover body.

The cover body is openably/closably disposed in the main body, and exposes an inside of the main body when the cover body is in an open state. The cover body has a first cover member, a second cover member, an engagement member, an elastic body, and a support member.

The first cover member covers a part of one surface of the main body when the cover body is in a closed state.

The second cover member has at least a rib or an opening portion.

The engagement member is engaged with the main body when the cover body is in the closed state.

The elastic body energizes the engagement member in a direction so that the engagement member is engaged with the main body.

The support member rotatably supports the engagement member. The support member collides with the engagement member which is energized by the elastic body and is rotated when the cover body becomes in the closed state, to stop rotation of the engagement member. The support member is fitted on the first cover member separately from the second cover member.

Hereinafter, an aspect of the present embodiment will be described. To begin with, a configuration of an image forming apparatus for realizing miniaturization thereof will be described with reference to the drawings. In the drawings, the same symbols indicate the same or similar portions.

FIG. 1A shows a configuration example of an image forming apparatus, and also shows a conveying direction of a sheet in the case of simplex printing. As shown in FIG. 1A, an image forming apparatus 100 has a sheet feeding cassette 1, a manual feed tray 10, an image forming unit 20, a scanner unit 8, a fixing device 6, a conveying path R1, a sheet discharge tray 11.

The scanner unit 8 scans a document sheet placed on a prescribed position, such as a document table disposed above the scanner unit 8, to read an image from the document sheet. The scanner unit 8 includes imaging elements such as CCDs (Charge Coupled Devices) or CISs (Contact Image Sensors). The scanner unit 8 reads an image from the document sheet placed on the document table, using the imaging elements, for example, to generate image data. The scanner unit 8 outputs the generated image data to the image forming unit 20.

The image forming unit 20 has process units C, M, Y, K for respective colors of C (cyan), M (magenta), Y (yellow), K (black). Each of the process units C, M, Y, K has a photoreceptor 21, an electrostatic charger 2, an LED head 3, a developing unit 14, and so on. In addition, the image forming unit 20 has a primary transfer unit 15 and a toner cartridge 5 for each of the process units C, M, Y, K. Further, the image forming unit 20 has a transfer belt 4 and a secondary transfer unit 16. The electrostatic charger 2 uniformly charges the photoreceptor 21. The LED head 3 exposes the photoreceptor 21, based on the image data outputted from the scanner unit 8, to form an electrostatic latent image on the photoreceptor 21. The developing unit 14 develops the electrostatic latent image using toner, to form a toner image according to the image data. The primary transfer units 15 respectively transfer the toner images from the photoreceptors 21 to the transfer belt 4 in the order of C, M, Y, K, to form a color toner image on the transfer belt 4. The toner cartridges 5 respectively feed the toners of C, M, Y, K to the developing units 14. The transfer belt 4 endlessly travels, while carrying the above-described toner image. The secondary transfer unit 16 transfers the toner image (hereinafter, may be simply called an image) from the transfer belt 4 to a sheet, to form an image on the sheet (a copy function). In addition the image forming unit 20 forms an image on the transfer belt 4 as described above, based on print data to be transmitted by another information processing apparatus via a network, and transfers the image from the transfer belt 4 to a sheet, to form an image on the sheet (a print function).

The fixing device 6 includes a heat generating element, and pressurizes the image transferred onto the sheet, while heating the image at a prescribed temperature, to fix the image to the sheet.

The sheet feeding cassette 1 houses sheets of a prescribed size. The manual feed tray 10 supports sheets of a prescribed size which has been placed by a user. The sheet is fed from the sheet feeding cassette 1 and the manual feed tray 10 to the image forming unit 20, by a sheet feeding mechanism not shown.

The sheet to be fed from the sheet feeding cassette 1 and the manual feed tray 10 is conveyed to the image forming unit 20 (the secondary transfer unit 16) via the conveying path R1.

The image forming unit 20 transfers the image, based on the image data of the document sheet which has been read by the scanner unit 8, or the print data to be transmitted from another information processing apparatus, from the transfer belt 4 onto the sheet. The fixing device 6 pressurizes the sheet to be conveyed from the image forming unit 20 (the secondary transfer unit 16) via the conveying path R1, while heating the sheet, to fix the image transferred to the sheet to the sheet. In the case of the simplex printing, after the image has been fixed to one surface (the front surface) of the sheet, the sheet is discharged to the sheet discharge tray 11 by a sheet discharge roller 7.

Figure 1B:
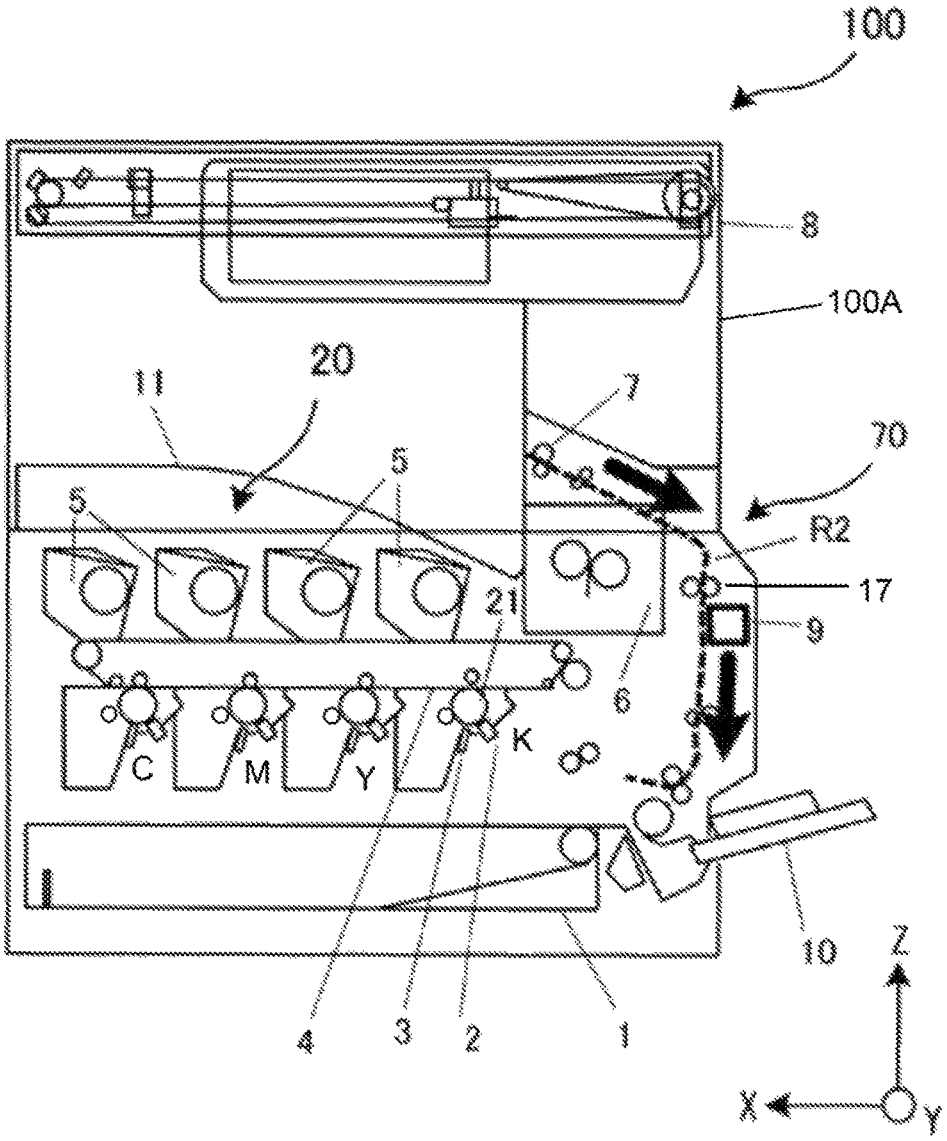

On the other hand, in the case of the duplex printing, in order to form an image on the other surface (the back surface) of the sheet, the sheet with the image formed on one surface is conveyed via a conveying path R2, as shown in FIG. 1B, and thereby the front/back of the sheet is reversed. Further the sheet with the front/back being reversed is conveyed to the image forming unit 20 (the secondary transfer unit 16), as shown in FIG. 1C.

Figure 1C:
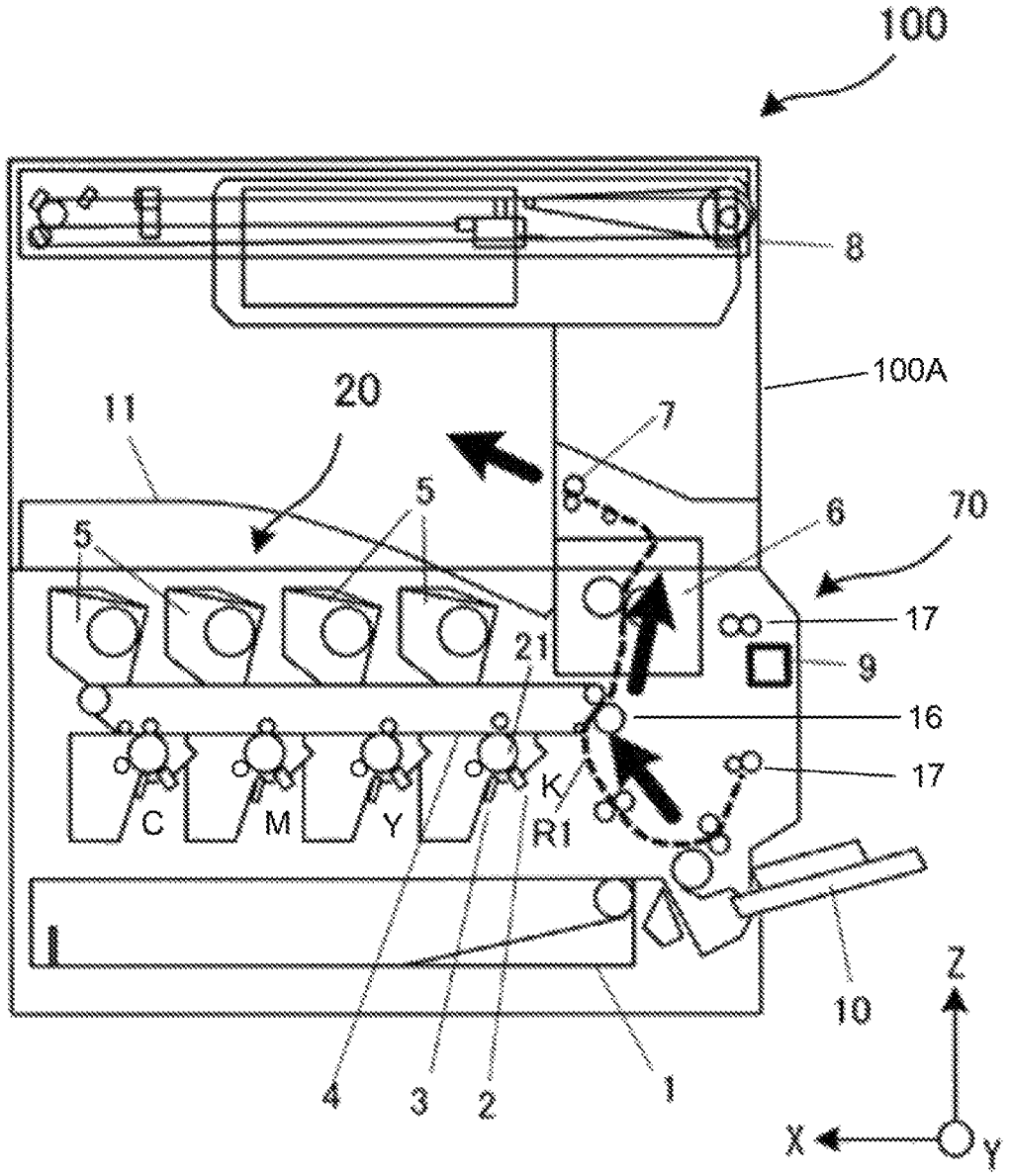

And, after the transfer processing and the fixing processing have been performed to the other surface of the sheet in the same manner described above, the sheet is discharged to the sheet discharge tray 11, as shown in FIG. 1C.

In addition, a conveying roller 17 is disposed on the above-described conveying path R2. As described above, the conveying roller 17 conveys the sheet with the image formed on one surface thereof to the image forming unit 20, via the conveying path R2.

After the image has been transferred and fixed to one surface of the sheet, in order to transfer and fix an image to the other surface, a power for making the sheet to be conveyed so that the front/back of the sheet is reversed, after the image has been fixed to the one surface, is required. A duplex printing drive motor 9 is a motor for performing this sheet conveyance. The duplex printing drive motor 9 transmits a power from a shaft of the drive motor to the conveying roller 17 via a timing belt, a gear and so on, to make the conveying roller 17 convey the sheet. In order to secure an installation space of this duplex printing drive motor 9, a main body 100A of the image forming apparatus 100 is of a chassis shape with a projection portion 70 formed on a side surface thereof.

Figure 2:
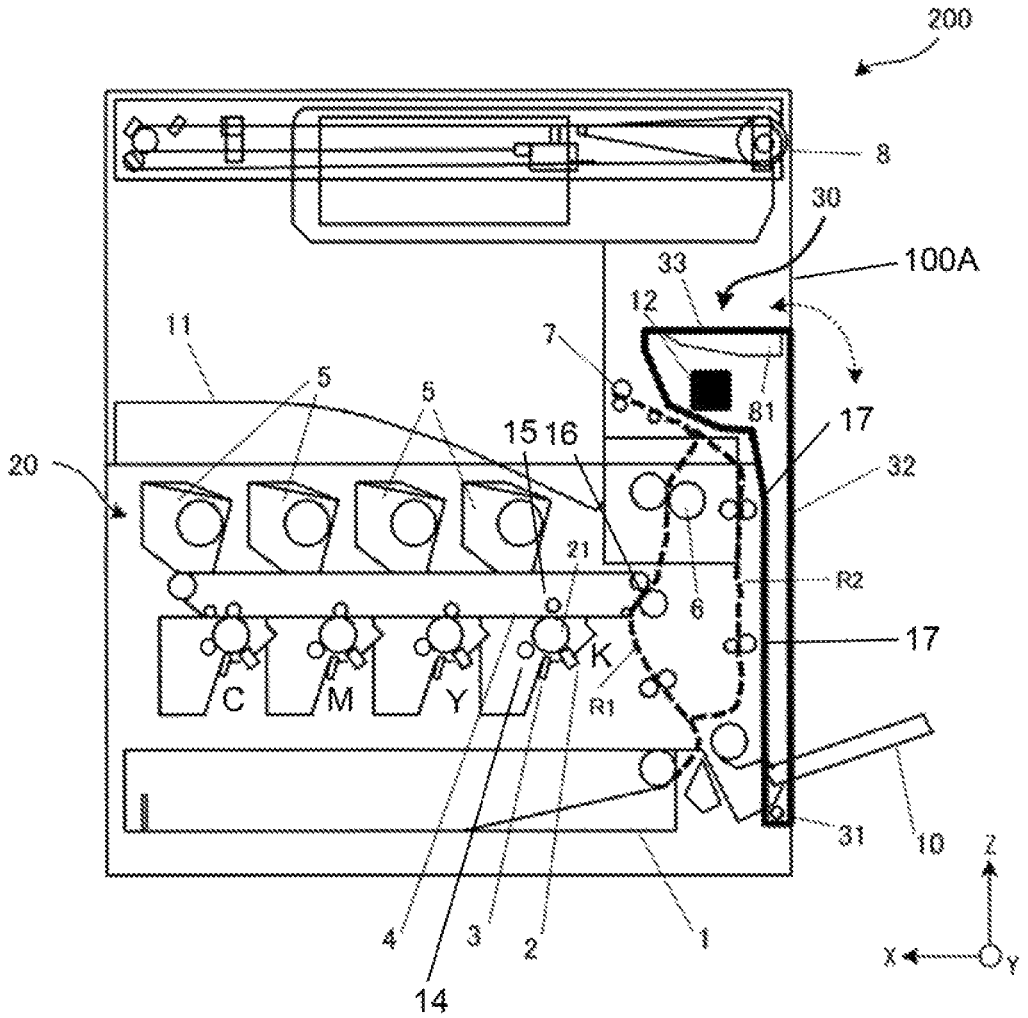
FIG. 2 is a sectional view showing an image forming apparatus according to an embodiment.

FIG. 2 shows an image forming apparatus 200 in which the projection portion 70 is not disposed. In the image forming apparatus 200, a duplex printing drive motor 12 is arranged above the fixing device 6, as shown in FIG. 2. By this means, the projection portion on the side surface is eliminated, and thereby miniaturization of the image forming apparatus is enabled.

In addition, a cover body 30 (hereinafter, called a side cover) to be openably/closably disposed on the main body 100A is schematically shown in FIG. 2. The side cover 30 is rotated around a shaft 31 in a dashed line arrow direction, to become in an open state or a closed state, and the inside of the main body 100A is exposed when the side cover 30 is in an open state. The inside of the main body 100A includes a position of the fixing device shown in FIG. 3, for example. The side cover 30 has a first cover member 32 (hereinafter, called a side surface member) which forms a side surface of the side cover 30, that is, covers the side surface thereof, in the closed state thereof shown in FIG. 2, and a second cover member 33 (hereinafter, called an upper surface member) which forms an upper surface of the side cover 30. The upper surface member 33 has a plurality of large and small reinforcing ribs 81. The side surface member 32 forms a part of an exterior cover of the image forming apparatus 200.

In the closed state of the side cover 30, the duplex printing drive motor 12 is located below the upper surface member 33 and above the fixing device 6 in the present example. In addition, the duplex printing drive motor 12 is installed inside the side cover 30, but if an installation space can be secured, it may be installed on a sheet metal chassis located at the back surface of the machine body outside the side cover 30, for example.

Figure 3:
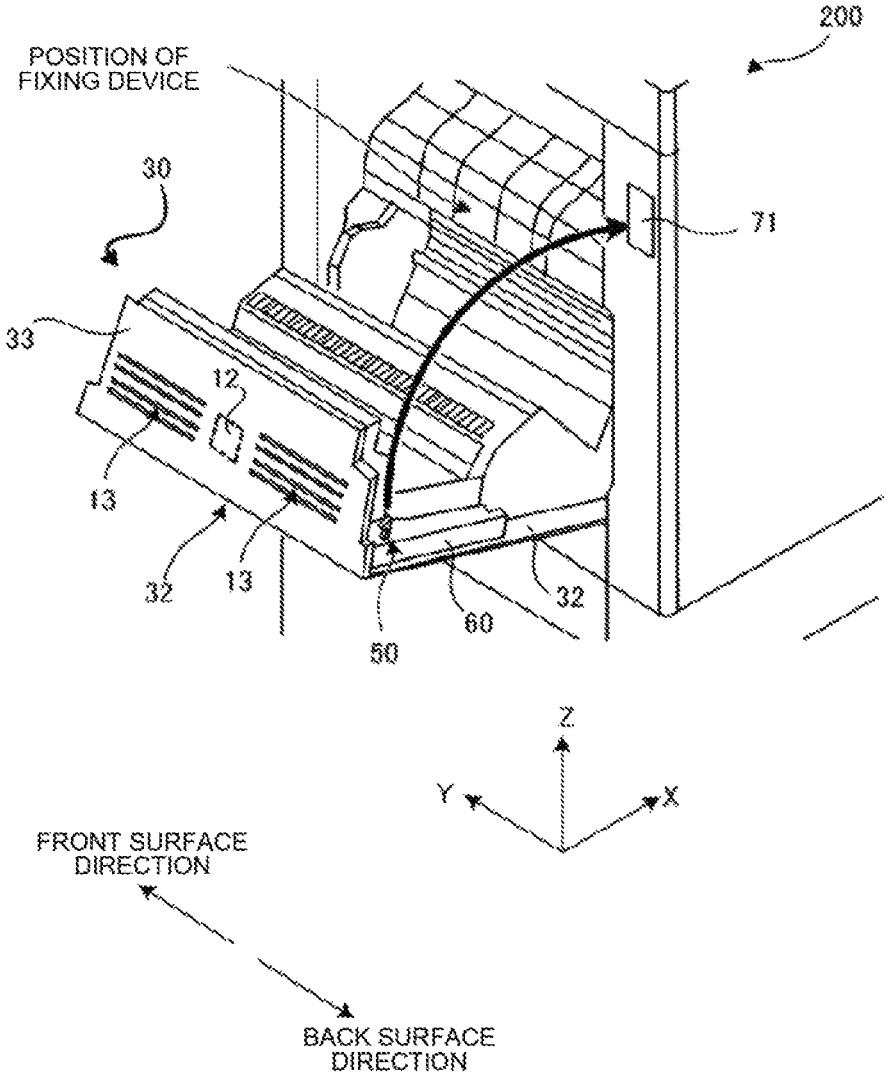
FIG. 3 is a perspective view of the image forming apparatus of the embodiment when a conventional side cover is applied to the apparatus.

FIG. 3 shows a perspective view of the image forming apparatus 200 when the side cover 30 is in the open state. The side cover 30 has slit-like ventilation openings 13 to be disposed in the upper surface member 33. When the duplex printing drive motor 12 is disposed above the fixing device 6, high temperature air which has been heated by the fixing device 6 becomes light and thereby rises, and flows around the duplex printing drive motor 12. In addition to this, the place around the motor 12 becomes in a high temperature state due to the heat generated by the duplex printing drive motor 12 itself. As countermeasure to the high temperature, cooling by a fan is thought of, but it causes cost increase, and the noise of the fan also becomes a problem. For this reason, in the present example, the ventilation openings 13 for releasing the high temperature air are disposed in the upper surface member 33 which becomes an upper surface of the side cover 30 when the side cover 30 is in the closed state.

The side cover 30 has an engagement member 50 (hereinafter, called a hook member), and a support member 60. The hook member 50 is engaged with the main body 100A, when the side cover 30 is in the closed state, to fix the side cover 30 to the main body 100A. Specifically, the hook member 50 is hooked with an opening portion 71 formed in the main body 100A, for example, to fix the side cover 30. FIG. 3 shows only the back surface side (refer to a back surface direction of FIG. 3) of the image forming apparatus 200, but the opening portion 71 is similarly formed in the main body 100A also at the front surface side (refer to a front surface direction of FIG. 3), and the hook member 50 is hooked with the opening portion 71, to fix the side cover 30. That is, the side cover 30 is hooked with the image forming apparatus 200 at two places of the front surface side and the back surface side.

FIG. 3 shows an example of the side cover 30 to which a conventional structure is applied, in the mounting structure of the support member 60 and the upper surface member 33, in order to explain a mechanism of generating impact sound described later. The support member 60 shown in FIG. 3 is a member integrated with the upper surface member 33 of the side cover 30, and rotatably supports the hook member 50.

Figure 4A:
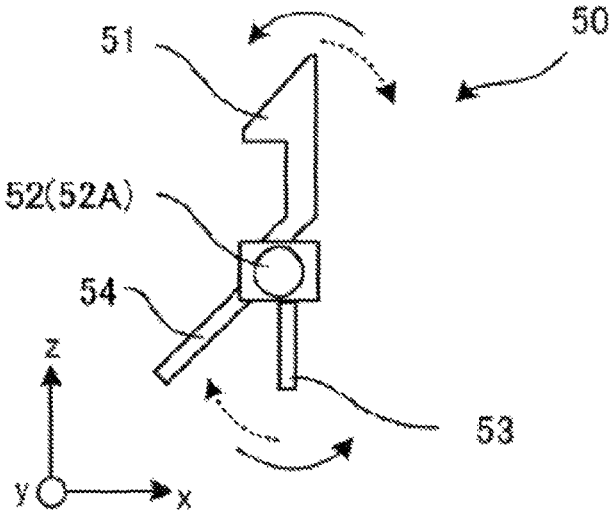
FIG. 4A and FIG. 4B are diagrams each showing the hook member of the image forming apparatus according to the embodiment.
Figure 4B:
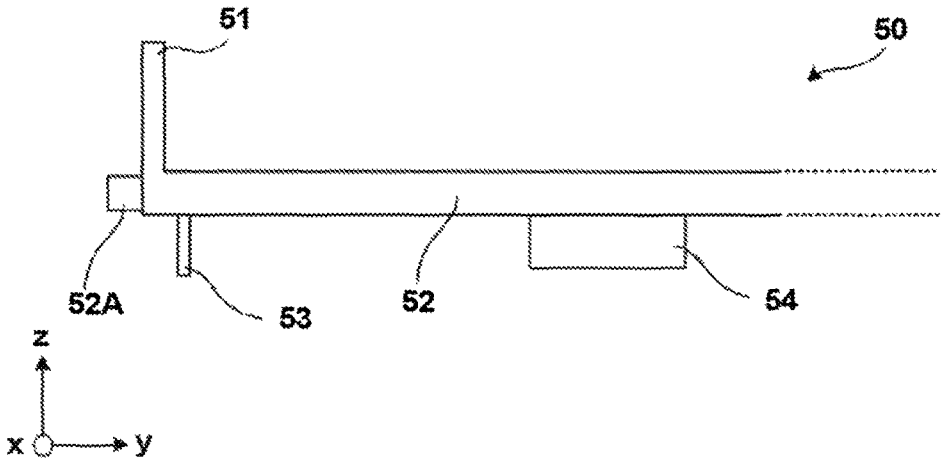
Figure 5:
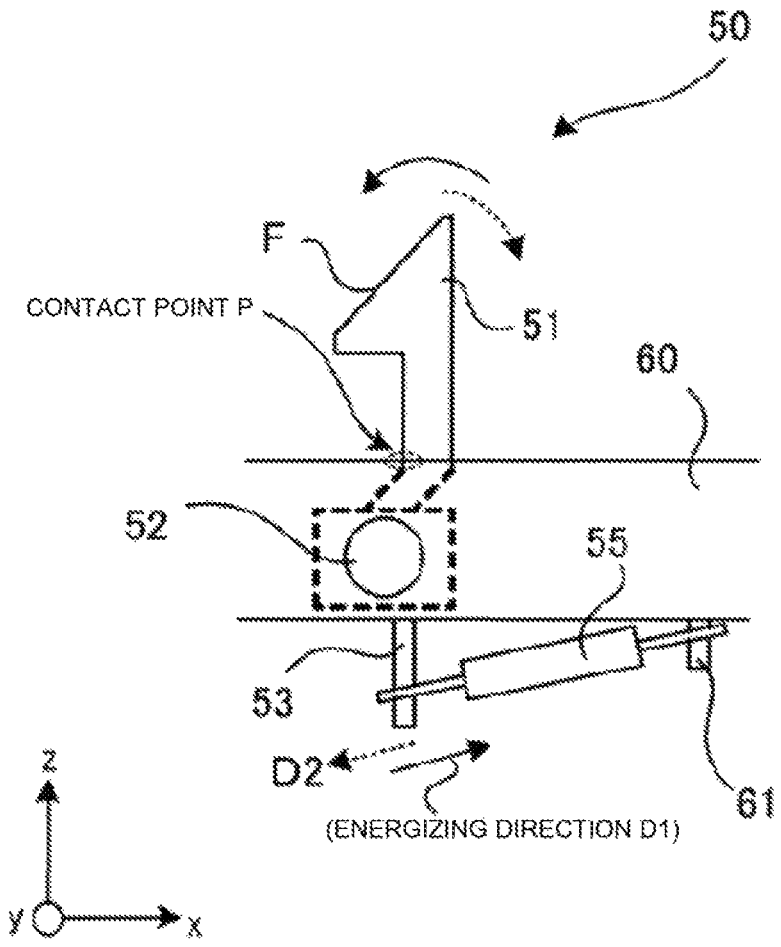
FIG. 5 is a diagram for describing a mechanism to generate an impact sound in the image forming apparatus of the embodiment.

The hook member 50 will be described with reference to FIGS. 4A, 4B. In addition, coordinate systems of FIGS. 4A, 4B and FIG. 5 are set as the coordinate system when the side cover 30 is in the closed state. That is, the x coordinate direction of FIGS. 4A, 4B and FIG. 5 is coincident with the X coordinate direction of FIG. 1A to FIG. 3. Similarly, the y coordinate direction and the z coordinate direction of FIGS. 4A, 4B and FIG. 5 are respectively coincident with the Y coordinate direction and the Z coordinate direction shown in FIG. 1A to FIG. 3.

The hook member 50 has a hook 51 which is in direct contact with and hooked with the opening portion 71 of the main body 100A, and a spring mounting portion 53. The hook 51 and the spring mounting portion 53 rotate around a shaft 52 in a clockwise direction (a dashed line arrow) and a counterclockwise direction (a solid line arrow) on the paper of FIG. 4A. In addition, the hook 51 and the spring mounting portion 53 are located at an end portion side of the shaft 52 in the longitudinal direction as shown in FIG. 4B. FIG. 4B shows only the hook 51 and the spring mounting portion 53 at one end portion side of the shaft 52, but the hooks 51 and the spring mounting portions 53 are located at the both end portion sides of the shaft 52. In addition, endmost portions 52A (hereinafter simply called end portions) of the shaft 52 are rotatably supported by the support member 60 shown in FIG. 3.

A lever member 54 which a user uses when the user opens and closes the side cover 30 is located at an approximately central portion of the shaft 52 in the longitudinal direction as shown in FIG. 4B. The hook 51, the spring mounting portion 53, and the lever member 54 are mounted on the same shaft 52, and thereby they are rotated integrally. That is, the lever member 54 is subjected to a rotation operation by the user, and thereby the hook 51 and the spring mounting portion 53 are also rotated in the direction of each of the arrows shown in FIG. 4A.

A mechanism of generating an impact sound when the side cover 30 becomes in the closed state will be described using FIG. 3 to FIG. 5. The side cover 30 has a coil spring 55. The coil spring 55 has one end coupled with the spring mounting portion 53 and another end coupled with a mounting portion 61 on the support member 60 side. The coil spring 55 energizes the spring mounting portion 53 in an energizing direction D1 shown by a solid line arrow. The hook 51 is rotated in the direction of a solid line arrow of a curved line around the shaft 52 by this energization. That is, the coil spring 55 energizes the hook 51 in the direction so that the hook 51 is hooked with the opening portion 71 of the main body 100A, to rotate the hook 51. The hook 51 comes in contact with the support member 60 at a contact point P shown in FIG. 5, by this rotation. The hook 51 comes in contact with the support member 60, to receive a reaction force. By this reaction force, the rotation of the hook 51 becomes in a stop state.

As described above, the side cover 30 is opened and closed by a user, when a sheet jam has occurred in the main body 100A. When the user opens the side cover 30, the user operates the lever member 54 in the direction of D2, and thereby the hook 51 is rotated in the direction of a dashed line arrow of a curved line. By this means, the hooking of the hook 51 with the opening portion 71 of the main body 100A is released, and thereby the side over 30 becomes in the open state.

When the jam is eliminated, and the side cover 30 is closed, the hook 51 slides, while acting against the energization of the coil spring 55, and while a slope F thereof is in contact with the opening portion 71 at the main body side. And when the hook 51 is hooked with the opening portion 71 at a step portion under the slope F of FIG. 5, a reaction force against the energization of the coil spring 55 is released. When this reaction force is released, the hook 51 comes in contact with the support member 60 supporting the hook member 50 at the contact point P, and thereby an impact sound is generated. The impact sound at this time is propagated and spreads throughout the side cover 30, to cause the ribs 81 and the slit-like opening portions 13 to be affected, and thereby a high-pitched unpleasant sound is generated.

Figure 6:
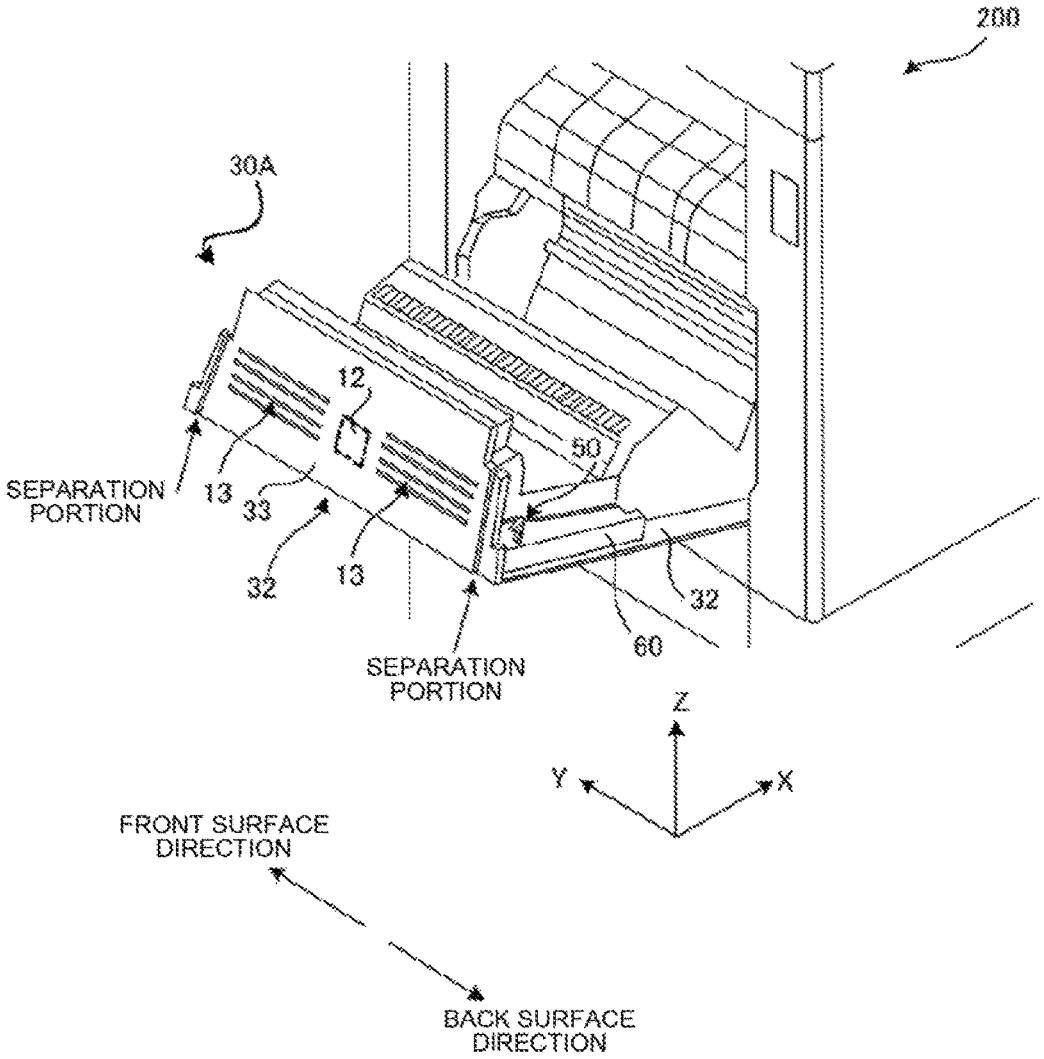
FIG. 6 is a diagram showing an example of the side cover of the image forming apparatus according to the embodiment.

Accordingly, in the present embodiment, the upper surface member 33 having the ribs 81 and the slit-like opening portions 13, and the support member 60 that is a generation place of an impact sound are separately arranged as separate components, as shown by a side cover 30A shown in FIG. 6 (refer to a separation portion of FIG. 6). The support members 60 are located at the both ends of the side cover 30A in the Y axis direction, while sandwiching the upper surface member 33 therebetween. In addition, the support member 60 is fitted on the side surface member 32 on which an opening portion and a rib are not disposed, or the side surface member 32 in which an area of the opening portion is smaller than the upper surface member 33 and the number of the ribs is smaller than the upper surface member 33. Further, the upper surface member 33 is also fitted on the side surface members 32.

Since a rib and an opening portion are not disposed on the side surface member 32 (or smaller numbers thereof are disposed), even if the support member 60 to generate the above-described impact is fitted on the side surface member 32, a vibration wavelength of an impact sound become long, and the impact sound becomes a low sound. In addition, that an area of the side surface member 32 is larger than an area of the upper surface member 33, as in the side cover 30A shown in FIG. 6 becomes a factor to reduce a high-pitched sound. According to the present embodiment, sound quality of an impact sound which is generated when the side cover 30A is closed is improved, and thereby uncomfortable feeling of a user is reduced.

In addition, the upper surface member 33 having the ribs and the opening portions, and the support member 60 to generate the above-described impact become in a state in which they are physically connected to each other via the side surface member 32. However, since an impact sound generated in the support member 60 attenuates till it reaches the upper surface member 3, a high-pitched sound quality is reduced.

In the side cover 30A of the image forming apparatus of the embodiment, a generation place (the support member 60) of an impact sound when the side cover 30A is closed, and a surface member (the upper surface member 33) in which when the impact sound is propagated, a high frequency sound is propagated are separated, and the both are in a non-contact state. The generation place of an impact sound and the surface member in which a high frequency sound is propagated are both fitted on an exterior cover (the side surface member 32) having a large area of the image forming apparatus, and become in an integrated state. Even if the impact sound is propagated in the member having a large area like this, a wavelength of the vibration becomes long and the impact sound becomes a low sound. Accordingly, the sound quality is improved when the side cover is closed, and thereby uncomfortable feeling of a user is reduced.

In the above-described embodiment, the upper surface member 33 is configured to have both of a plurality of the ribs 81 and the opening portions 13, but the upper surface member 33 may be configured to have any one or both of one or a plurality of the ribs 81 or one or a plurality of the opening portions 13.

In addition, if a member is an opening and closing member disposed in the image forming apparatus, except the side cover, the above-described embodiment can be applied to such a member.

As described above in detail, according to the image forming apparatus of the embodiment, it is possible to reduce an uncomfortable sound when the opening and closing member is closed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a main body; and a cover body which is openably/closably disposed in the main body, and exposes an inside of the main body when the cover body is in an open state;

the cover body comprising:

a first cover member which covers a part of one surface of the main body when the cover body is in a closed state;

a second cover member having at least a rib or an opening portion;

an engagement member which is engaged with the main body when the cover body is in the closed state;

an elastic body which energizes the engagement member in a direction so that the engagement member is engaged with the main body; and a support member which is fitted on the first cover member separately from the second cover member, rotatably supports the engagement member, and collides with the engagement member that is energized by the elastic body and is rotated when the cover body transitions to the closed state, to stop rotation of the engagement member.

2. The image forming apparatus according to claim 1, wherein:

the support member and the second cover member are separate components.

3. The image forming apparatus according to claim 2, wherein:

the support member and the second cover member are connected via the first cover member.

4. The image forming apparatus according to claim 1, wherein:

the first cover member has an area which is large enough to attenuate an impact sound that is generated when the engagement member collides with the support member and is propagated to the second cover member, and the first cover member is also larger than the second cover member.

5. The image forming apparatus according to claim 1, wherein:

the main body comprises an image forming unit to form an image on a sheet, and a fixing device to fix the image formed by the image forming unit to the sheet; and the second cover member is located above the fixing device when the cover body is in the closed state.

6. The image forming apparatus according to claim 5, wherein:

the cover body has a conveying roller which reverses a front or a back of the sheet having the image fixed to one surface thereof and conveys the sheet to the image forming unit when the cover body is in the closed state, and a motor to drive the conveying roller; and the second cover member is located above the motor, when the cover body is in the closed state.

7. The image forming apparatus according to claim 6, wherein:

the motor is located above the fixing device when the cover body is in the closed state.

8. The image forming apparatus according to claim 7, wherein:

the motor is located between the second cover member and the fixing device when the cover body is in the closed state.

9. The image forming apparatus according to claim 1, wherein:

the support member and the second cover member are disposed on the first cover member and separated from each other.

* * * * *